US007522742B2

(12) United States Patent
Francisco et al.

(10) Patent No.: US 7,522,742 B2
(45) Date of Patent: Apr. 21, 2009

(54) SPEAKER ASSEMBLY WITH MOVEABLE BAFFLE

(75) Inventors: Jeffrey L. Francisco, Riverside, CA (US); Jeremy P. Burkhardt, Riverside, CA (US)

(73) Assignee: Speakercraft, Inc., Riverside, CA (US)

( * ) Notice: Subject to any disclaimer, the term of this patent is extended or adjusted under 35 U.S.C. 154(b) by 702 days.

(21) Appl. No.: 11/085,940

(22) Filed: Mar. 21, 2005

(65) Prior Publication Data

US 2006/0215866 A1 Sep. 28, 2006

(51) Int. Cl.
*H04R 25/00* (2006.01)

(52) U.S. Cl. ..... 381/345; 381/351; 381/162

(58) Field of Classification Search ..... 381/182, 381/386, 387, 395, 332–336, 391, 345, 351, 381/162; 181/150
See application file for complete search history.

(56) References Cited

U.S. PATENT DOCUMENTS 3,680,936 A * 8/1972 Backhaus ..... 312/7.1
4,139,734 A * 2/1979 Fincham ..... 381/335
4,296,280 A * 10/1981 Richie ..... 381/99
4,884,655 A * 12/1989 Freadman et al. ..... 181/145
5,400,412 A 3/1995 King, Sr. et al.
5,721,401 A * 2/1998 Sim ..... 181/148
5,952,619 A 9/1999 Kantor et al.
D419,561 S 1/2000 Haase et al.
6,070,694 A * 6/2000 Burdett et al. ..... 181/150
6,101,262 A 8/2000 Haase et al.
6,766,027 B2 * 7/2004 Ryan et al. ..... 381/182
2002/0118853 A1 * 8/2002 Flentje ..... 381/336

* cited by examiner

*Primary Examiner*—Suhan Ni
*Assistant Examiner*—Jasmine Pritchard
(74) *Attorney, Agent, or Firm*—Hogan & Hartson LLP

(57) ABSTRACT

A speaker assembly includes a housing that can be attached to a wall. Audio speakers are mounted in a baffle that is mounted in and movable relative to the housing, so that the direction of audio signals emitted from the speakers can be selected and controlled. End and side retaining surfaces extend rearwardly from the housing and define an enclosure within which the baffle is mounted and moveable relative to the housing. Slotted channels are formed in the end retaining surfaces, and the baffle is moveably attached to the housing by fasteners extending from end mounting surfaces formed in the baffle and through the slotted channels formed in the housing. The speakers may also be mounted to be moveable relative to the baffle.

11 Claims, 12 Drawing Sheets

SPEAKER ASSEMBLY WITH MOVEABLE BAFFLE

BACKGROUND OF THE INVENTION

1. Field of the Invention

The present invention relates to speaker assemblies.

2. Description of Related Art

Home entertainment and stereo systems have become increasingly popular. Typical home entertainment and stereo systems include a stereo receiver system with a plurality of peripherals, such as DVD players, CD players, satellite receivers, etc., and a plurality of audio speakers. The speakers are typically free-standing on a floor, shelf or other surface, and thus can be easily positioned to generate audio signals in a direction of the listener's choice.

Some listeners prefer to mount audio speakers in a wall. In a home entertainment system, for example, the speakers may be mounted in a wall adjacent a viewing monitor or television. In-wall speakers are usually mounted in a fixed manner, however, and direct audio signals in a direction generally perpendicular to the plane of the wall. Thus, in-wall mounting of speakers has an associated drawback of not easily allowing a user to direct audio signals in a preferred direction. Sound quality and the overall listening experience may consequently be diminished.

SUMMARY OF THE INVENTION

One embodiment of the invention is a speaker assembly comprises a housing, and a baffle moveably attached to the housing and having an audio speaker attached thereto so that the speaker can be selectively positioned with respect to the housing.

Another embodiment of the invention is a speaker assembly comprising a housing with end and side retaining surfaces extending rearwardly from the housing to define an enclosure within which a baffle is mounted and moveable relative to the housing. Slotted channels are formed in the end retaining surfaces. At least one mounting mechanism is provided to secure the housing to a mounting surface so that the housing is fixed relative to the mounting surface. A baffle is moveably attached to the housing by fasteners extending from end mounting surfaces formed in the baffle and through the slotted channels formed in the housing. A plurality of audio speakers are mounted in the baffle, and at least one of the audio speakers is moveable relative to the baffle.

Other features and advantages of the invention will be apparent from the following detailed description, taken in conjunction with the accompanying drawings which illustrate, by way of example, various features of embodiments of the invention.

DETAILED DESCRIPTION OF THE INVENTION

Reference will now be made to the drawings wherein like numerals refer to like parts throughout.

Speaker assembly 100 comprises, generally, a baffle 106 moveably attached to a housing 102. Speakers 132, 134 and 136 are mounted in baffle 106 and are thus moveable relative to housing 102 via movement of baffle 106. As will be described, the speakers themselves may be moveable relative to baffle 106.

Figure 1A:
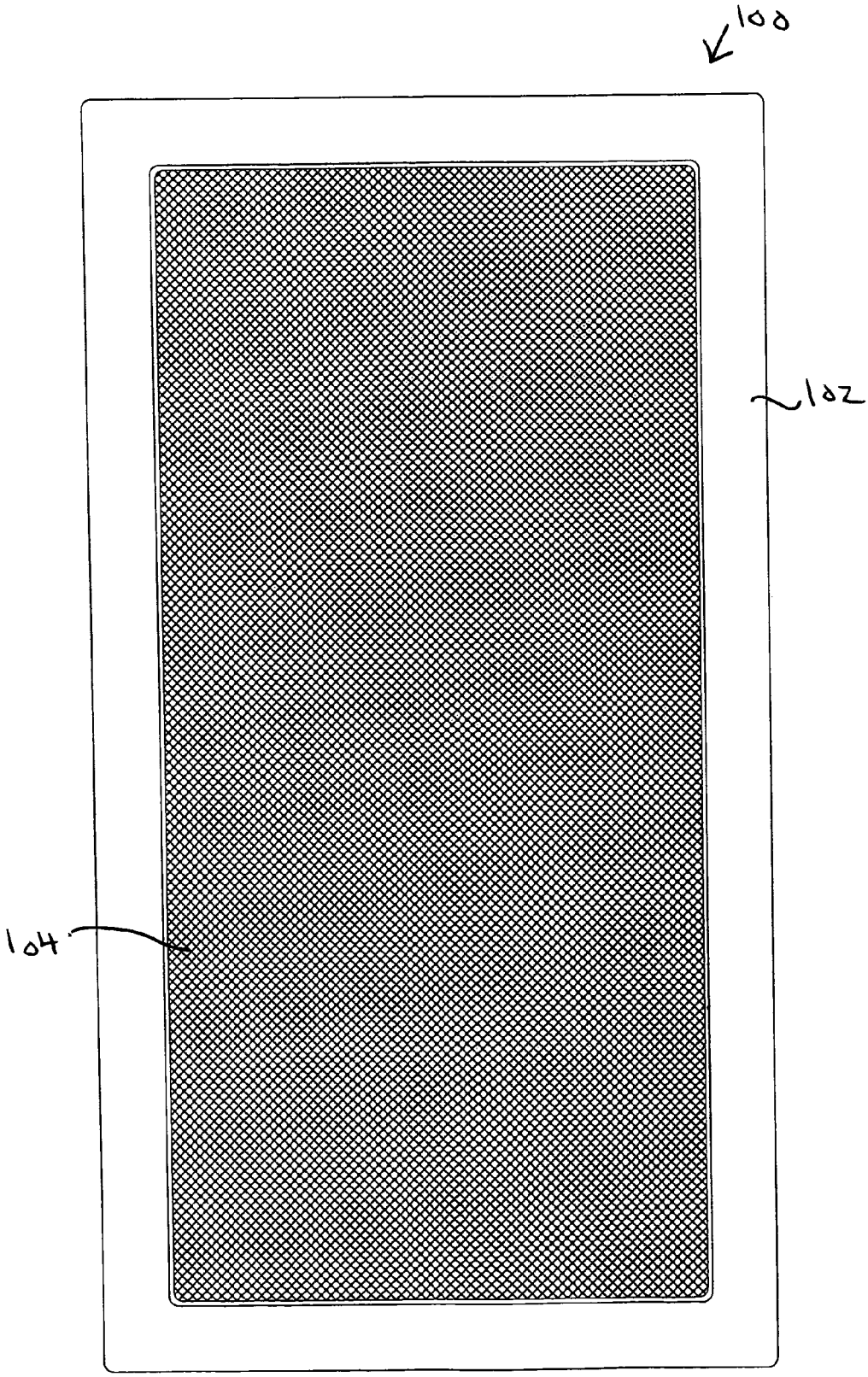
FIG. 1A is a front view of a speaker assembly having a housing with a removable protective screen.
Figure 1B:
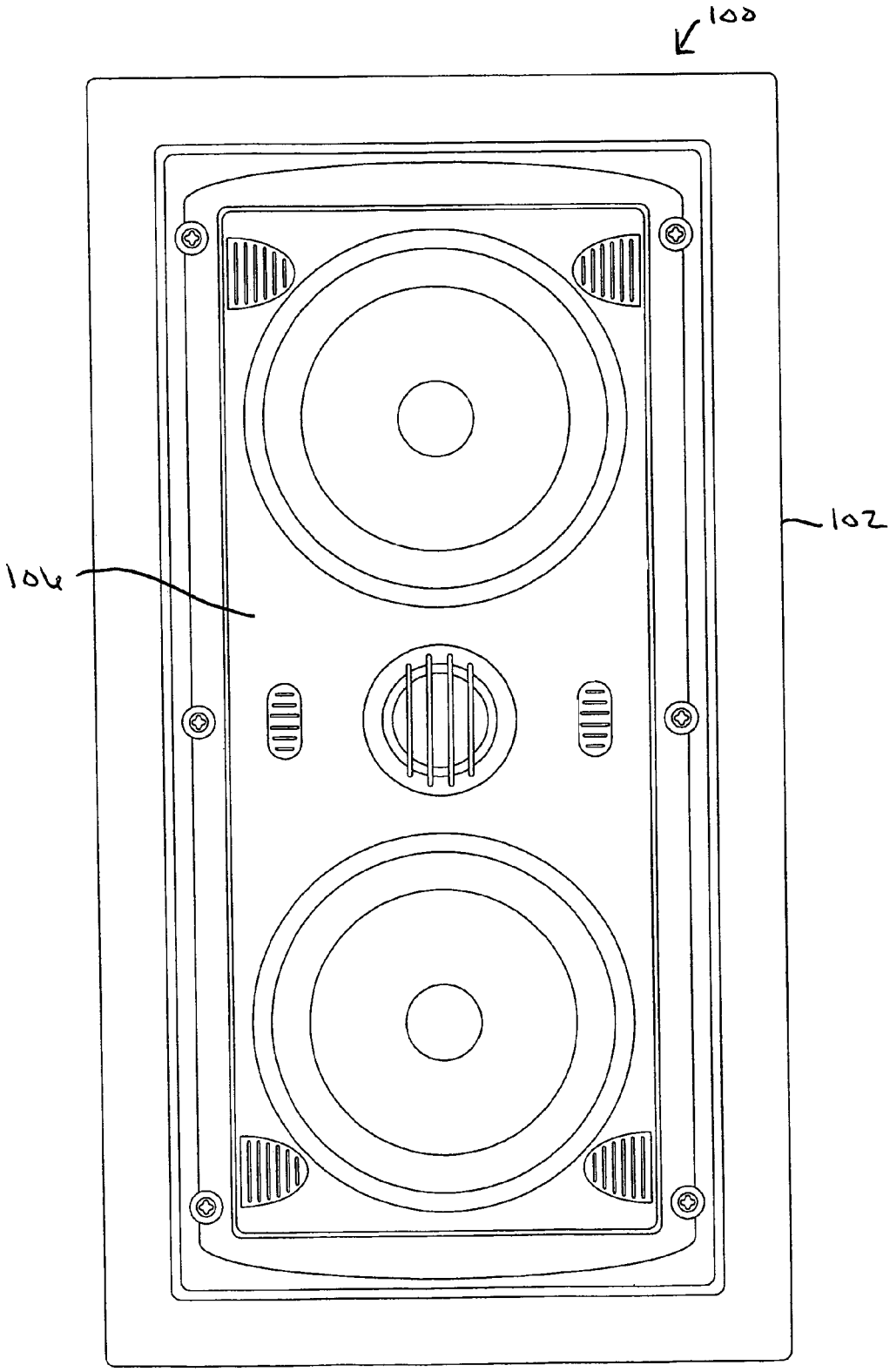
FIG. 1B is a front view of speaker assembly having a moveable baffle positioned in the housing.
Figure 1C:
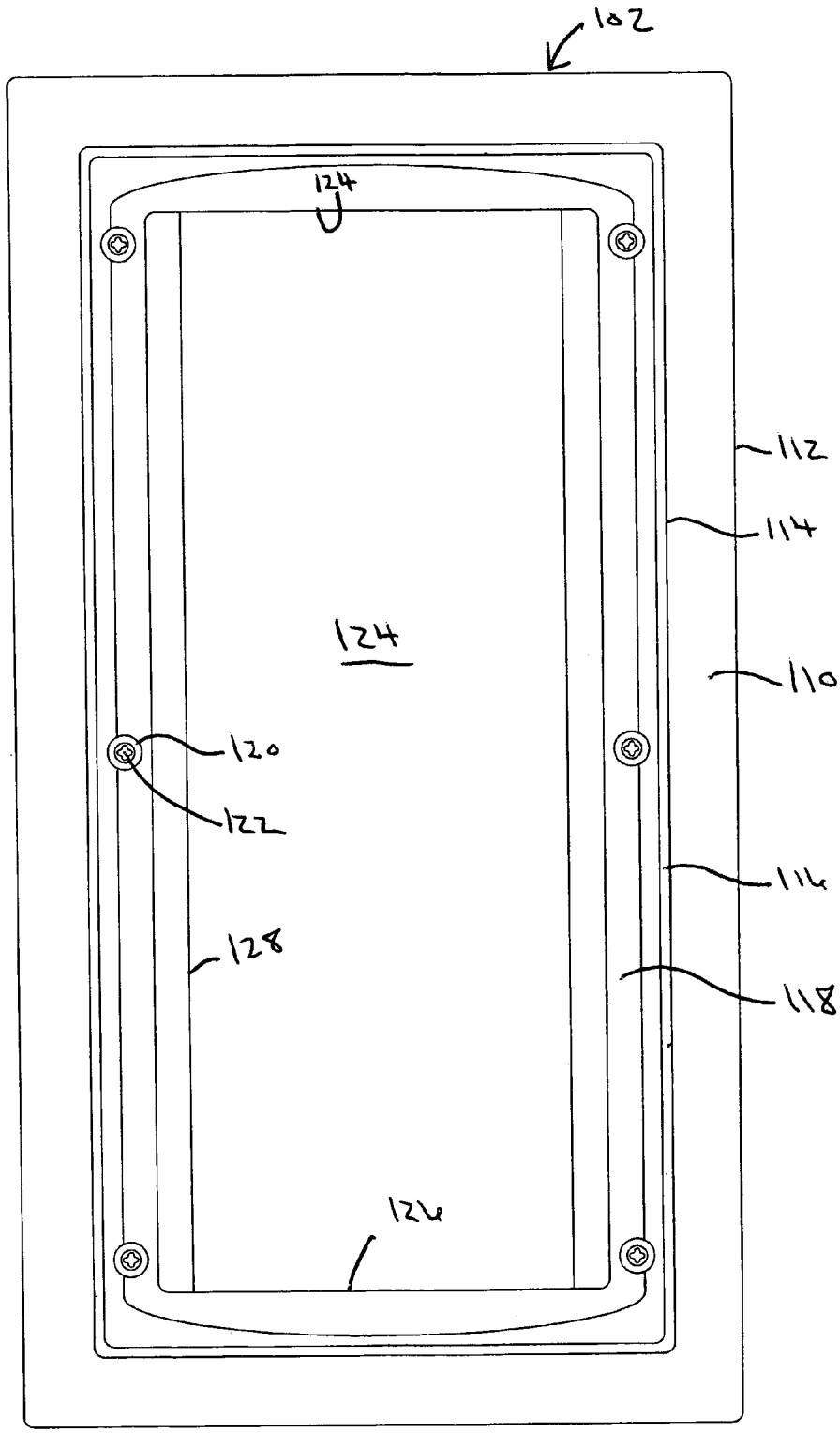
FIG. 1C is a front view of the housing.
Figure 1D:
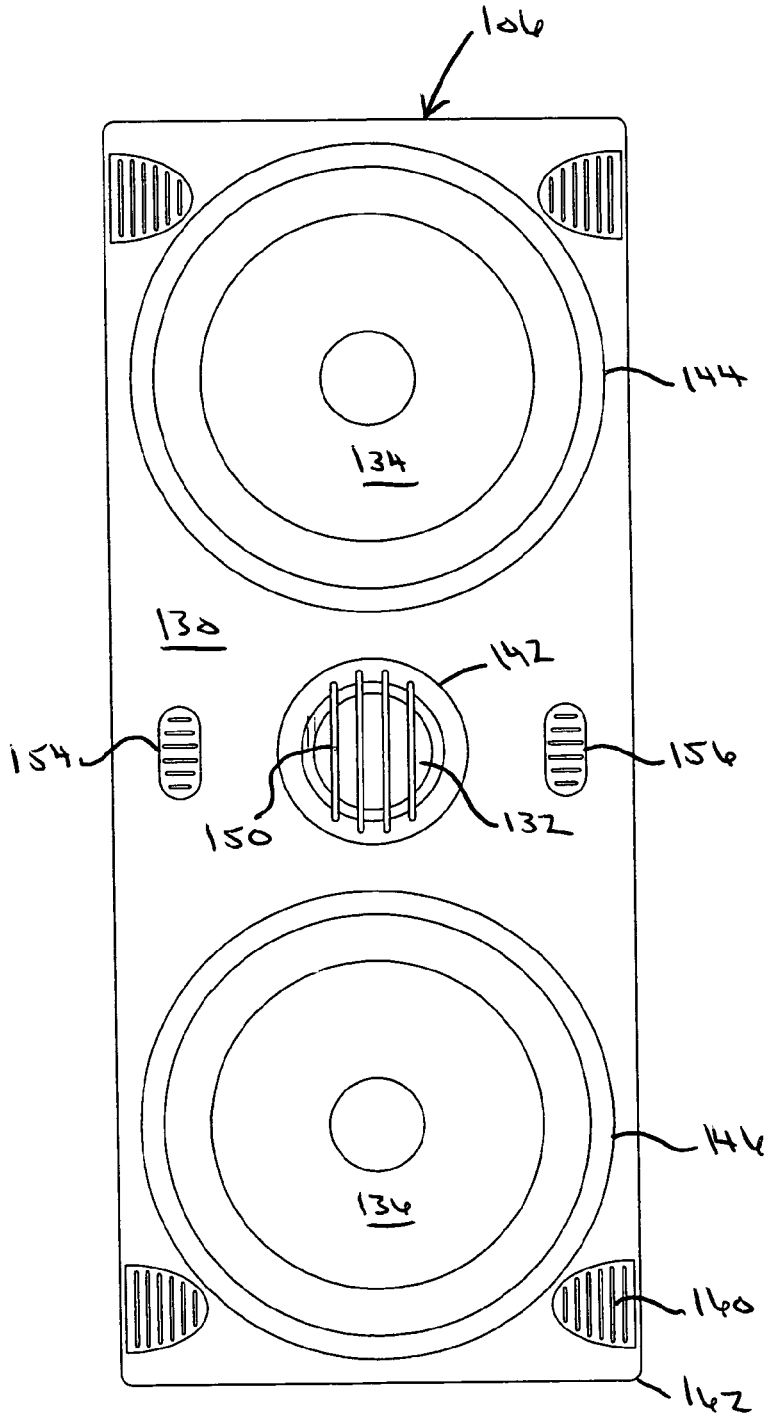
FIG. 1D is a front view of the baffle.
Figure 2A:
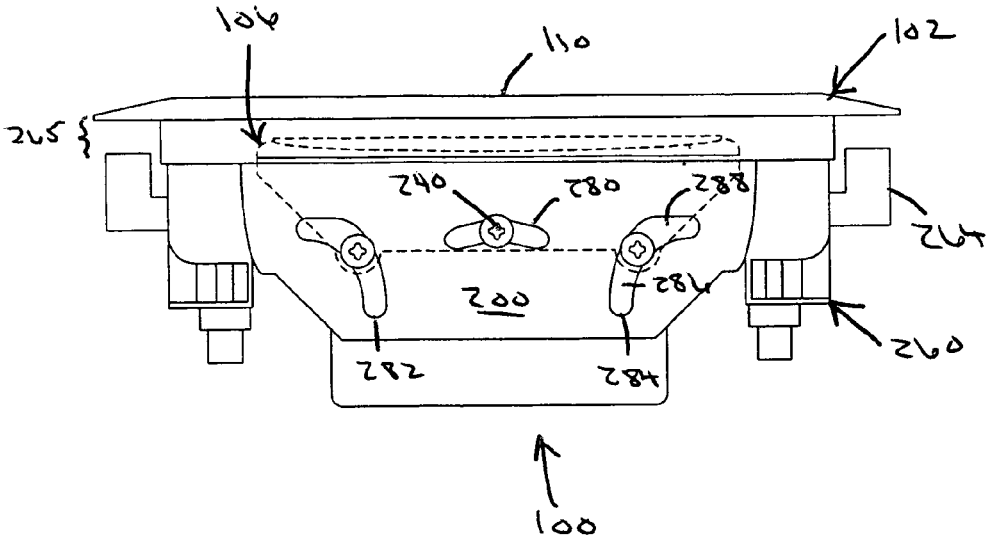
FIG. 2A is a top or bottom view of the speaker assembly.
Figure 2B:
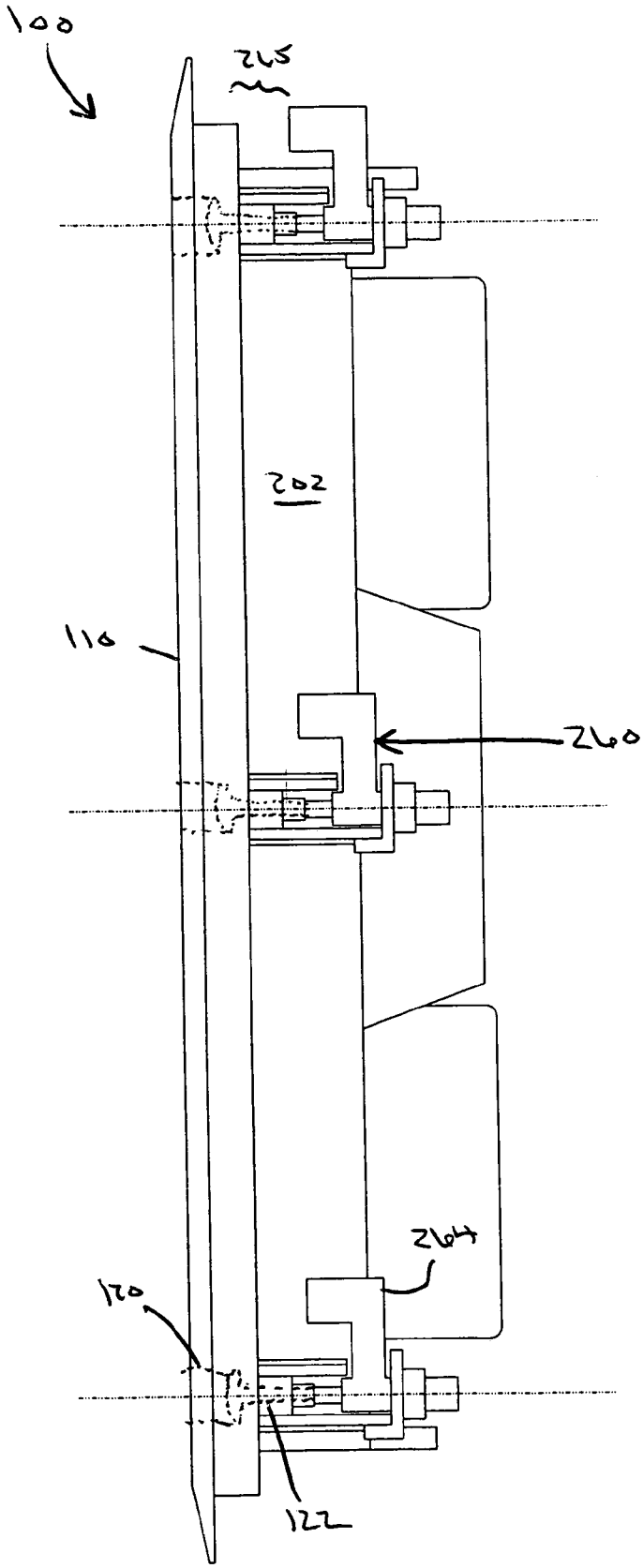
FIG. 2B is a side view of the speaker assembly.

In describing speaker assembly 100, reference will be made to FIGS. 1A-D. FIG. 1A is a front view of a speaker assembly 100 showing a removable protective screen 104 attached to housing 102. FIG. 1B is a front view of speaker assembly 100 with screen 104 removed to show moveable baffle 106 positioned in housing 102. FIG. 1C shows housing 102 alone, with screen 104 and baffle 106 removed. FIG. 1D illustrates baffle 106 in more detail.

Speaker assembly 100 comprises, in one embodiment, an in-wall speaker assembly that can be positioned and retained in an opening in a wall. The present invention is suitable for use in a wall in any type of structure including, for example, residential, commercial, warehouse, and industrial buildings, as well as moveable structures including mobile dwellings, recreational vehicles, automobiles, ships, buses, trains and aircraft. "Wall" or "walls" as discussed herein encompasses any type of interior or exterior wall or equivalent surface in such structures.

With reference to FIG. 1C, housing 102 includes a rectangular outer housing portion 110 extending between an outer edge 112 and an inner edge 114. In one embodiment, as better shown in FIGS. 4-6, a slight upward incline from outer edge 112 to inner edge 114 is provided so that assembly 100 stands out slightly when installed in a wall. Outer housing portion 110 surrounds inner housing portion 118. A rectangular slotted channel 116 is defined between the outer and inner housing portions, and serves as a receptacle for receiving and retaining a mating portion of protective screen 104. Inner housing portion 118 is slightly recessed relative to outer housing portion 110 (better shown in FIGS. 4-6) so that the outer surface of protective screen 104, when installed, will cover inner housing portion 118 and be flush with the inner edge 114 of outer housing portion 110. Mounting holes 120 are formed in inner housing portion 118 to receive first fasteners 122 for securing housing 102 to a wall. A rectangular mounting aperture 124 is defined by interior sides 126, 128 of inner housing portion 118 and is configured to receive and moveably retain baffle 106.

Baffle 106, shown installed in housing 102 in FIG. 1B and alone in FIG. 1D, includes a front portion 130 with audio speakers 132, 134, 136 securely mounted within circular mounting apertures 142, 144, 146. In one embodiment, first speaker 132 interposed between second and third speakers 134, 136 is a "tweeter"-type speaker for reproducing high-frequency audio signals, and second and third speakers 134, 136 are cone type speakers for reproducing mid-frequency to low-frequency audio signals. Speaker 132 may comprise, for example, a silk or aluminum dome, and speakers 134, 136 may comprise molded graphite cones or aluminum-magnesium cones with phasing domes. As will be described in more detail below, in one embodiment, speaker 132 is moveably mounted within mounting aperture 142 and thus may pivot and move with respect to baffle 106. It will be understood, of course, that baffle 106 may be configured to receive more or less than three speakers without departing from the scope of the invention.

Figure 3A:
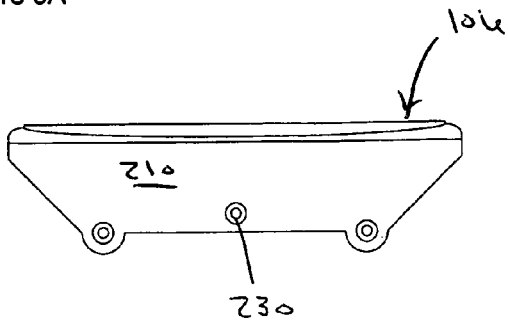
FIG. 3A is a top view of the baffle.
Figure 3B:
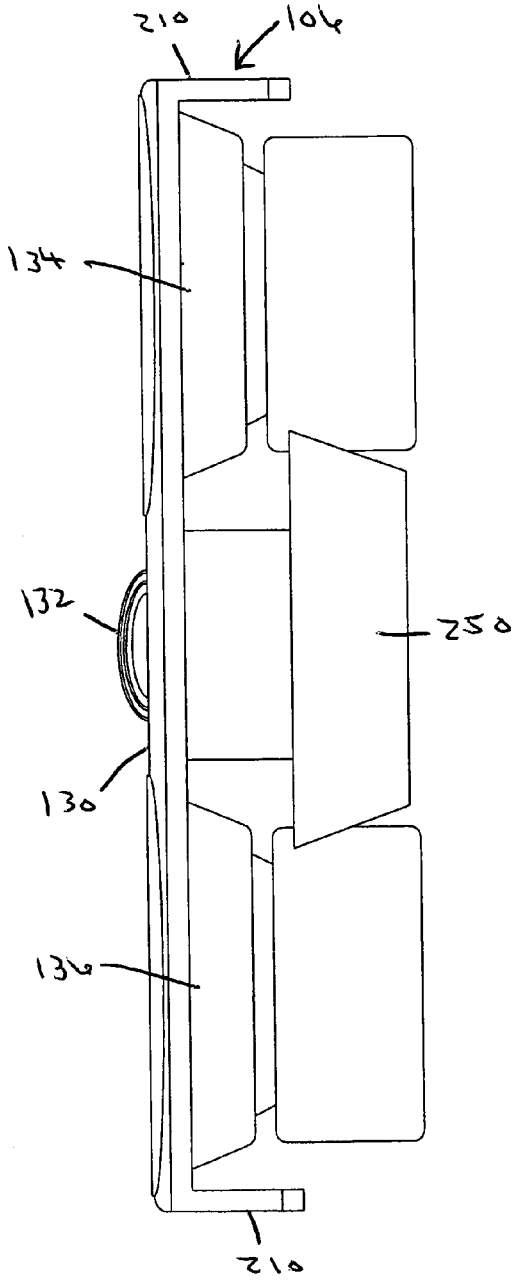
FIG. 3B is a side view of the baffle.

A protective grill 150 may be positioned over first speaker 132. User interface and input features may be provided for operation of speaker assembly 100. User-operated switches 154, 156, for example, may be provided to adjust the treble and bass response of the speakers. Baffle 106 may be formed with grip features 160 positioned adjacent corners 162 to provide a user with points of contact to move and selectively position baffle 106 relative to housing 102. As best shown in FIG. 3B, baffle 106 also includes enclosure 250 positioned behind front portion 130 to enclose circuit and control elements for providing and distributing audio signals from an audio signal source, such as a stereo amplifier or receiver, to speakers 132, 134, 136.

Housing 102 and baffle 106 are illustrated in further detail in FIGS. 2A-B and 3A-B. For illustrative clarity, the outline of baffle 106 is shown in dashed lines in FIGS. 2A-B. Mounting mechanisms 260, which are positioned and extend from the rear perimeter of housing 102, are provided to attach speaker assembly 100 to a wall or other mounting surface. In one embodiment, six mounting mechanisms (three per side of assembly 100) are provided. Other numbers of mounting mechanisms may be provided as appropriate for a particular installation.

Each mounting mechanism 260 includes an L-shaped arm 264 coupled by threaded attachment to fastener 122, which extends through mounting hole 120 formed in housing 102 and into a threaded receiving bore formed in arm 264. Thus, by tightening fastener 122, the gap 265 between housing 102 and arm 264 may be narrowed to secure an edge portion of a wall to which assembly 100 is to be mounted between arm 264 and housing 102. Speaker assembly 100 may be removed from the wall on which it is mounted by loosening fastener 122 such that the gap 265 between housing 102 and arm 264 is widened to release the edge portion of the wall secured therebetween.

End retaining surfaces 200 extend rearwardly from the top and bottom of housing 102, and side retaining surfaces 202 extend rearwardly from the sides of housing 102. Together, surfaces 200 and 202 define a space or enclosure within which baffle 106 is attached and may move relative to housing 102. Side retaining surfaces 202 may be contoured to facilitate pivotal movement of baffle 106 about a lengthwise (top to bottom) axis of housing 102, and include end stop members 292 (see, e.g., FIGS. 4-6) to limit pivotal movement of baffle 106 relative to housing 102.

End mounting surfaces 210 extend rearwardly from the top and bottom of baffle 106 (FIG. 3B) and include means for attachment to end retaining surfaces 200 of housing 102. In one embodiment, fasteners 240 extend upwardly from baffle end surfaces 210 and through slotted channels 280, 282 and 284 formed in housing end surfaces 200. Channels 280, 282, 284, have smooth inner surfaces that receive and allow fasteners 240 to move, shift, pivot, or slide therein. First slotted channel 280 is interposed between channels 282, 284 and defines a first guiding path to allow sliding, shifting, or pivoting movement of baffle 106 in a direction that is generally parallel to front portion 110 of housing 102. Second and third channels 282, 284 each comprise first portions 286 and second portions 288, and define second and third guiding paths that allow movement of baffle 106 in first portions 286 in a direction that is generally perpendicular to housing front portion 110, and movement in second portions 288 in a direction that is generally parallel to housing front portion 110.

Figure 3C:
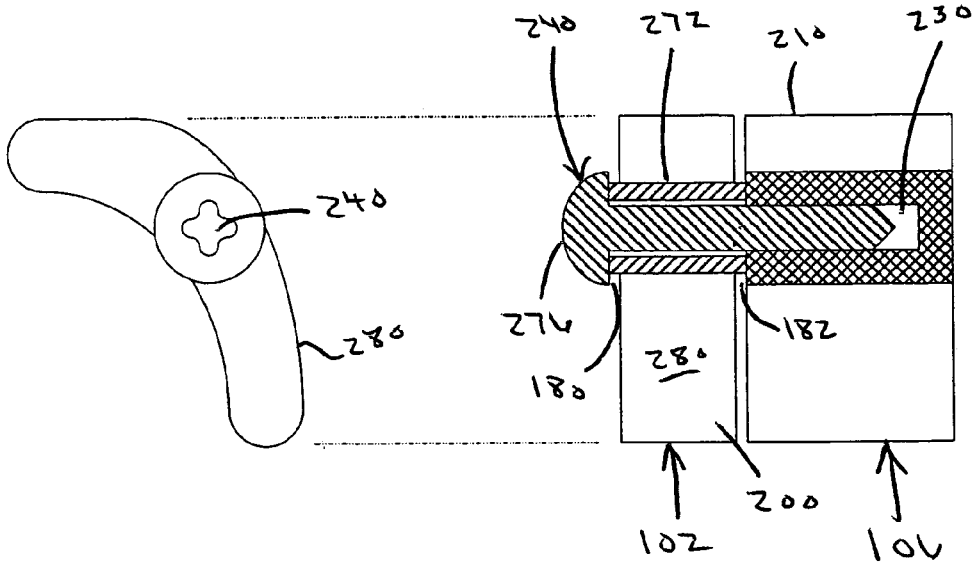
FIG. 3C is a side view and cross-sectional view of a portion of the housing and the baffle.

FIG. 3C is a cross-sectional view depicting the attachment of baffle 106 to housing 102 in more detail. In one embodiment, baffle end surfaces 210 are formed with receiving holes 230 to receive one end of fasteners 240 (FIGS. 3A and 3C). A fastener 240 extends through each of the slotted channels 280, 282, 284 formed in housing end retaining surfaces 200, and into the corresponding receiving hole formed in baffle end surfaces 210. Each fastener 240 may extend through a cylindrical spacer 272 mounted within the slotted channels between fastener head 276 and baffle end surface 210. Spacer 272 preferably has a length such that a first gap 180 is formed between fastener head 276 and an outer side of housing end surface 100, and a second gap 182 is formed between an inner side of housing end retaining surface 200 and baffle end surface 210, to thereby allow fastener 240 to be securely attach baffle 106 to housing 102 while still being able to slide or move within slotted channels 280, 282, 284 so that baffle 106 can move relative to housing 102.

The inner surfaces of slotted channels 280, 282, 284 may include partitions (not shown), either recessed or protruding, that define predetermined retaining positions of baffle 106 with respect to housing 102 and can prevent arbitrary or unwanted movement of baffle 106. The partitions may have a saw contour, semicircular contour, rectangular contour, trapezoidal contour, or any other appropriate shape or contour.

Baffle 106 is movable relative to housing 102 via the application of a depressing force or pressure to the sides of baffle 106. As previously described, grip features 160 are provided on the exterior of baffle 106 for this purpose. With application of sufficient pressure, baffle 106 slides, pivots or shifts within the contours of slotted channels 280, 282 and 284, and within housing side surfaces 202. Baffle 106 can thereby move within confined spaces, such as the interior of a wall in which speaker assembly 100 is mounted. Baffle 106 is not configured to move about a single pivot point, but instead shifts or pivots position by sliding along the guiding paths defined by slotted channels 280, 282, 284. This configuration provides baffle 106 with a greater range of movement within confined spaces. It should be understood, however, that baffle 106 could be mounted to housing 102 for relative movement in configurations other than those depicted herein without departing from the scope of the invention.

Figure 4A:
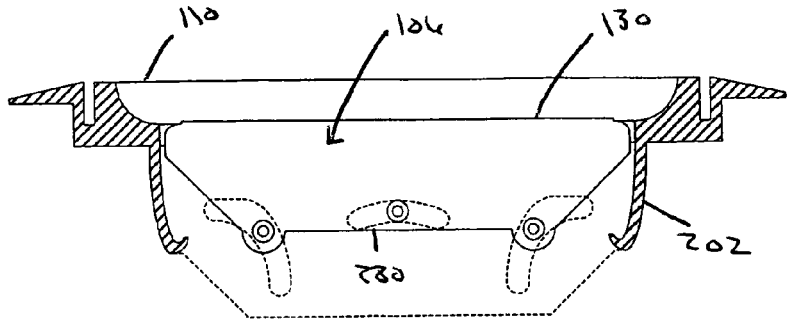
FIGS. 4A-4C are cross-sectional views of the speaker assembly showing the sliding or pivoting movement of the baffle with respect to the housing.
Figure 4B:
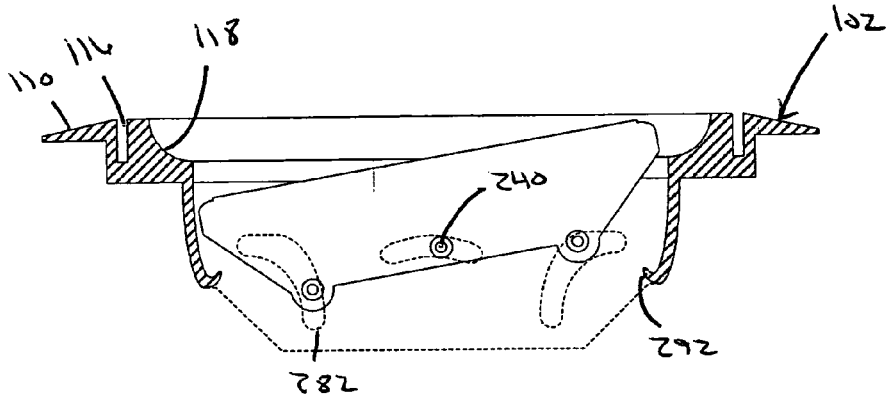
Figure 4C:
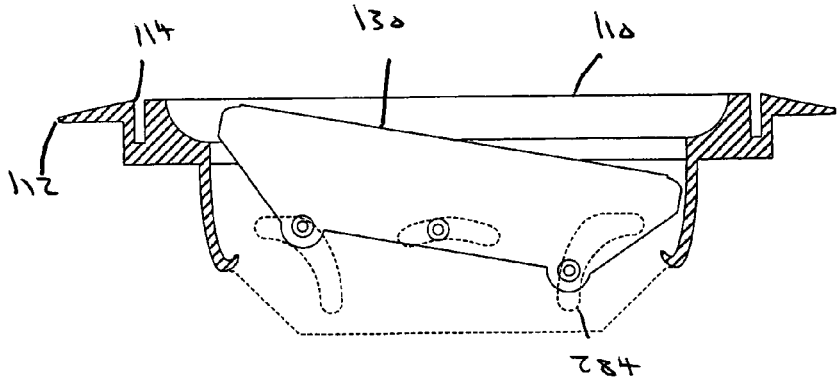

FIGS. 4A-4C are examples of movements of baffle 106 relative to housing 102 FIG. 4A shows baffle 106 in a first position, wherein baffle front portion 130 is generally parallel to housing front portion 110. FIG. 4B shows baffle 106 in a second position, wherein baffle front portion 130 is generally angled or offset in a first direction relative to housing front portion 110. FIG. 4C shows baffle 106 in a third position, wherein baffle front portion 130 is generally offset or angled in a second direction relative to housing front portion 110. Baffle 106 is moveable between and among these positions and to other positions depending on the contour and configuration of slotted channels 280, 282, 284. Baffle 106 may thereby be positioned such that the direction of audio signals emitted from the speakers mounted within baffle 106 can be very precisely controlled and set as desired.

Figure 5A:
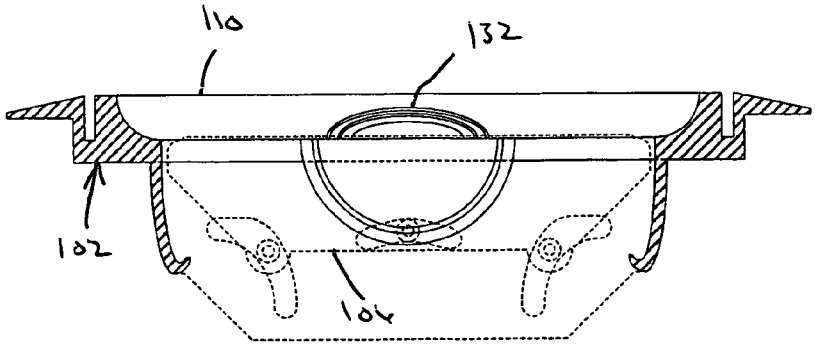
FIGS. 5A-5C are cross-sectional views of the speaker assembly showing the pivoting movement of a first speaker with respect to the baffle.
Figure 5B:
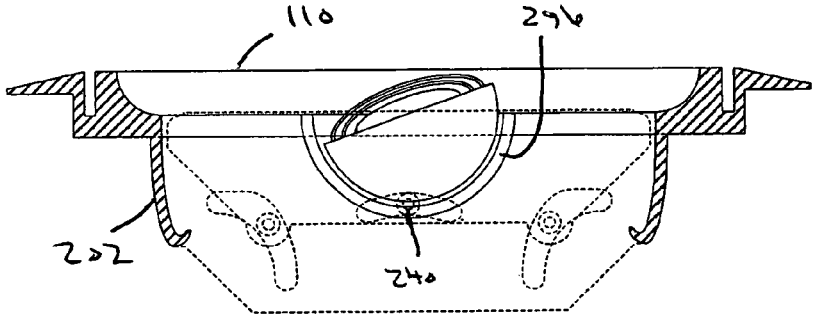
Figure 5C:
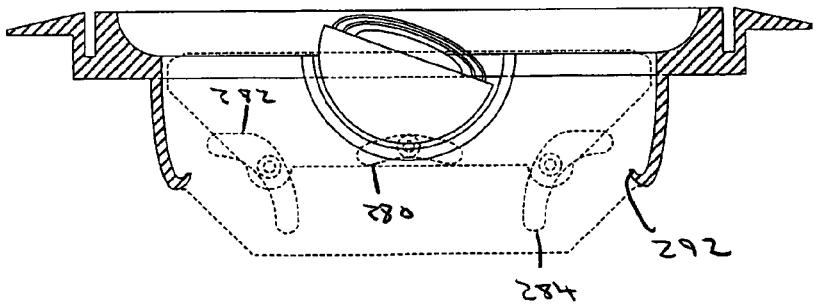

In addition to baffle 106, and thus speakers 132, 134, 136 mounted therein, being movable relative to housing 102, the speakers themselves may be relatively movable relative to baffle 106. FIGS. 5A-5C show how first speaker 132 may be configured to move relative to baffle 106, to provide an even greater ability to specifically direct audio signals. This may be particularly important for higher frequency signals provided by "tweeter"-type speaker 132. Baffle 106 includes a hemispherical recess 296 that receives and retains first speaker 132. Hemispherical recess 296 allows speaker 132 to pivot with respect to baffle 106 and be selectively positioned to direct audio signals in a desired direction. FIG. 5A shows first speaker 132 in a first position wherein a front portion 298 of first speaker 132 is generally parallel to baffle front portion 130 and housing front portion 110. FIG. 5B shows first speaker 132 in a second position wherein front portion 298 is generally angled or offset in a first direction relative to baffle front portion 130 and housing front portion 110. FIG. 5C shows first speaker 132 in a third position wherein front portion 296 is generally angled or offset in a second direction relative to baffle front portion 130 and housing front portion 110. As is readily apparent, first speaker 132 is moveable between and among these positions and may pivot to further positions within the confines of recess 296.

Figure 6A:
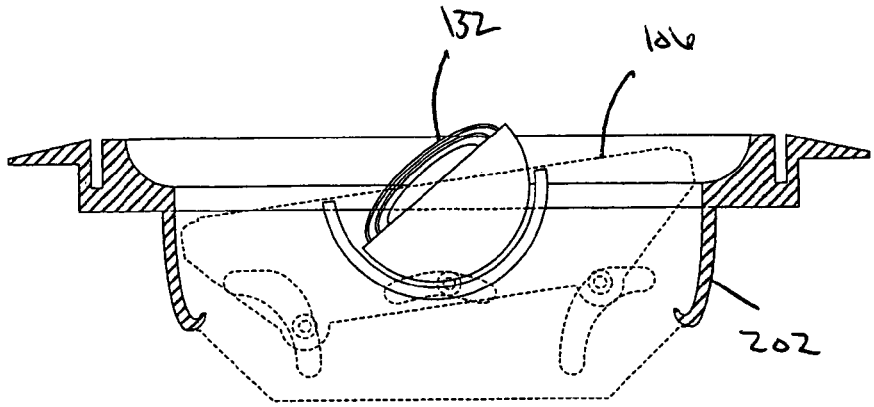
FIGS. 6A-6B are cross-sectional views of the speaker assembly showing the sliding or pivoting movement of the baffle with respect to the housing and the pivoting movement of the first speaker with respect to the baffle.
Figure 6B:
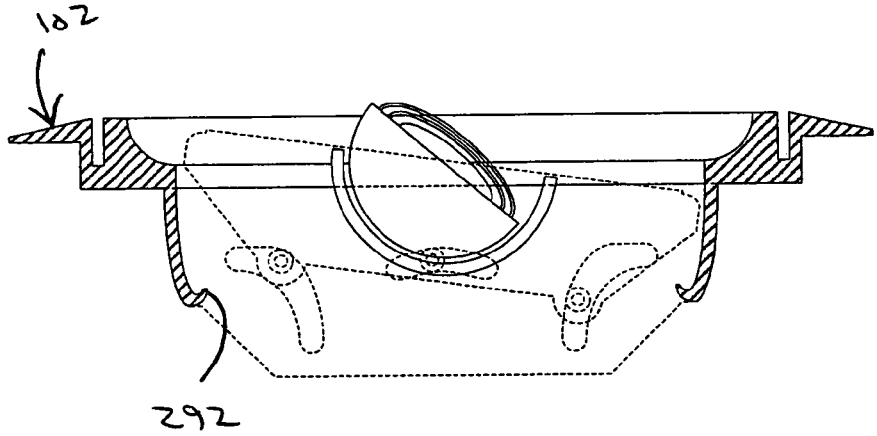

FIGS. 6A-6B show movement of baffle 106 relative to housing 102 independent of and in combination with movement of speaker 132 relative to baffle 106. Thus, speaker 132 has an even greater range of movement and can be selectively positioned even further in the first or second directions to direct audio signals. Moreover, if desired, speaker 132 may be positioned to direct audio signals in a different direction relative to the signals being emitted by speakers 134 and 136.

Figure 7A:
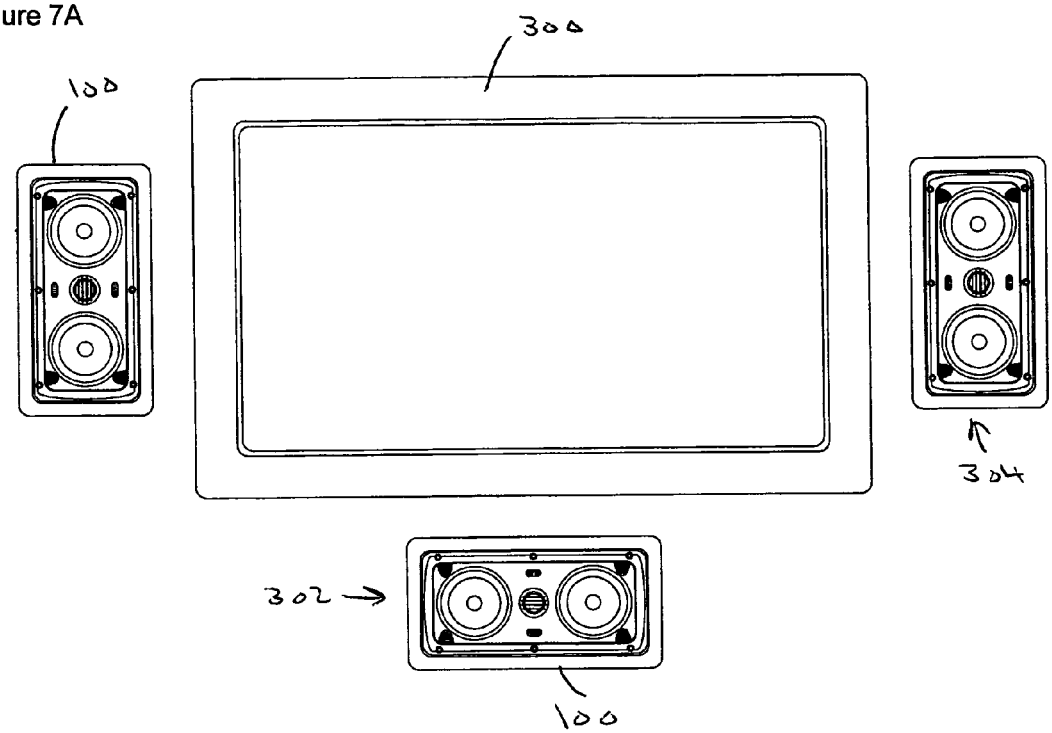
FIG. 7A is a front view showing the positioning of a plurality of speaker assemblies on a portion of a wall around a viewing monitor.

FIG. 7A shows a plurality of speaker assemblies 100 installed in a wall surrounding a viewing monitor 300. Speaker assemblies 100 are mounted in both a horizontal manner 302 and a vertical manner 304 to enhance the ability to provide specifically directed audio signals. It will be appreciated that speaker assemblies may be configured and oriented in any manner appropriate to the mounting surface and environment to provide a configurable acoustical environment.

Figure 7B:
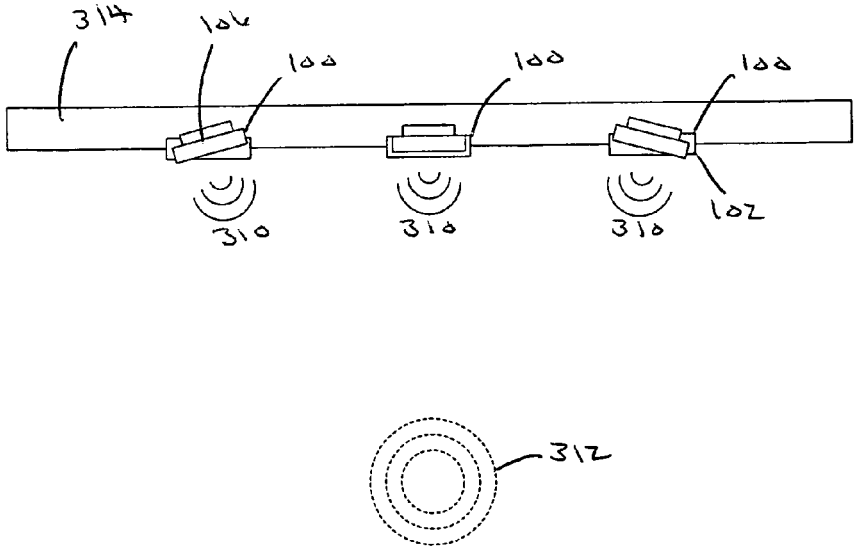
FIG. 7B is top view showing the positioning of a plurality of speaker assemblies and directing audio signals to provide a listening zone.

FIG. 7B shows speaker assemblies 100 mounted and directing audio signals 310 to provide a listening zone 312. Housings 102 of speaker assemblies 100 are attached to and mounted in wall 314 so as to be stationary relative to wall 314. Baffle 106, however, moves relative to housing 102 and wall 314 so that speakers 132, 134, 136 can be selectively positioned to direct audio signals 310 in a desired direction such as, for example, a listening zone 312.

Various embodiments of the invention have been described and are intended to be illustrative, rather than restrictive. Modification may be made without departing from the spirit and scope of the invention, which is established by the following claims.

What is claimed is:

1. A speaker assembly comprising:

a housing comprising a front portion;

a baffle moveably attached to the housing and having an audio speaker attached thereto so that the speaker can be selectively positioned with respect to the housing;

end mounting surfaces extending from the baffle; and end retaining surfaces and side retaining surfaces extending rearwardly from the housing and defining an enclosure within which the baffle is mounted and moveable relative to the housing, wherein slotted channels are formed in the end retaining surfaces, and fasteners extend through and into the end mounting surfaces, the fasteners being movable within the slotted channels, wherein the housing allows baffle movement with respect to the housing in a direction parallel to the front portion of the housing.

2. A speaker assembly as claimed in claim 1 wherein three slotted channels are formed in the end retaining surfaces, including a first slotted channel that allows movement of the baffle in a direction that is generally parallel to the housing, and second and third slotted channels that allow movement of the baffle in a direction that is generally perpendicular to the housing.

3. A speaker assembly as claimed in claim 2, wherein the second and third slotted channels also allow movement of the baffle in a direction that is generally parallel to the housing.

4. A speaker assembly as claimed in claim 1, wherein the side retaining surfaces are contoured and include stops at ends thereof to limit movement of the baffle.

5. A speaker assembly as claimed in claim 1, wherein the baffle includes grip features defining points of contact for application of force to move the baffle relative to the housing.

6. A speaker assembly as claimed in claim 1, wherein the housing is adapted to be positioned in an opening formed in a wall of a structure and retained to at least a portion of the wall.

7. A speaker assembly as claimed in claim 1, wherein three audio speakers are mounted in the baffle.

8. A speaker assembly as claimed in claim 1, wherein the speaker is movable relative to the baffle in which it is mounted.

9. A speaker assembly as claimed in claim 8, wherein the baffle is formed with a hemispherical recess in which the speaker is mounted in and moveable relative to the baffle.

10. The speaker assembly as claimed in claim 1, wherein the speaker is tiltable relative to the baffle in which it is mounted.

11. The speaker assembly as claimed in claim 1, wherein the housing allows baffle movement with respect to the housing in a direction perpendicular to the front portion of the housing.

* * * * *